United States Patent [19]

Hantschk

[11] 4,287,743

[45] Sep. 8, 1981

[54] METHOD AND DEVICE FOR THE MANUFACTURE OF HELICAL ROTOR BLANKS FOR HELICAL GEAR MACHINES

[75] Inventor: Günther Hantschk, Waldkraiburg, Fed. Rep. of Germany

[73] Assignee: Netzsch-Mohnopumpen GmbH, Fed. Rep. of Germany

[21] Appl. No.: 14,187

[22] Filed: Feb. 22, 1979

[30] Foreign Application Priority Data

Feb. 24, 1978 [DE] Fed. Rep. of Germany ..... 2808081

[51] Int. Cl.[3] ..... B21D 11/06

[52] U.S. Cl. ..... 72/98; 72/145; 72/371

[58] Field of Search ..... 72/95, 98, 100, 145, 72/168, 371, 66, 79, 135, 141; 29/156.4 R, 156.8 R

[56] References Cited

U.S. PATENT DOCUMENTS

| | | | |
|---|---|---|---|
| 717,552 | 1/1903 | Depew | 72/145 |
| 3,740,811 | 6/1973 | Kozusnik | 29/156.4 R |

FOREIGN PATENT DOCUMENTS

| | | | |
|---|---|---|---|
| 636198 | 2/1962 | Canada | 72/135 |
| 733197 | 3/1943 | Fed. Rep. of Germany | 72/135 |
| 617113 | 7/1978 | U.S.S.R. | 72/371 |

*Primary Examiner*—Lowell A. Larson

*Attorney, Agent, or Firm*—Karl W. Flocks; A. Fred Starobin

[57] ABSTRACT

The method and device for the manufacture of helical rotor blanks for helical gear machines by moving a straight cylindrical shaft in a direction along the shaft axis while rotating it around the shaft axis by means of passing the shaft between at least three bending rollers, and the opposite end of the shaft held by a rotatable clamping chuck geared for infinitely variable timed relative movement with a bending roller. A first bending roller has a ring groove with a circular arc profile and a second bending roller ring groove has an elliptical profile with the second ring groove either laterally displaced or of greater width than the ring groove in the first bending roller.

10 Claims, 9 Drawing Figures

METHOD AND DEVICE FOR THE MANUFACTURE OF HELICAL ROTOR BLANKS FOR HELICAL GEAR MACHINES

BACKGROUND OF THE INVENTION

The invention relates to a method for the manufacture of helical rotor blanks for helical gear machines in which a straight shaft of circular cylindrical shape is moved along the axis of said shaft, is rotated around said shaft axis and is formed without cutting. The invention further relates to a device for the application of this method.*

*Helical gear pumps are known e.g. from U.S. Pat. Nos. 2,527,673 to Byran, 2,603,161 to Lloyd and 3,139,035 to O'Connor, these pumps being said to be of the Moineau type. Motors of a corresponding type are known, e.g. from U.S. Pat. No. 3,879,094 to Tschirky et al.

In German Pat. (DE-PS) No. 1,703,828, a method is described for the manufacture of hollow, helical rotor blanks for helical gear from a tubular shaft, in which this shaft is re-shaped by a compression tool using a hoisting technique, said shaft being axially advanced and rotated in the intervals between the compression hoists. The forward motion along the shaft axis and the rotation around said axis thus take place step by step whenever the compression tool does not act upon the shaft. The compression tool comprises a ring consisting of segments through which the shaft can be moved and which, when its segments are closed, has an inner threaded surface with a conical pre-forming section and a cylindrical calibrating section, arranged behind it, as seen in the direction of the motion of the shaft.

Satisfactory results can be obtained with this method as long as precisely calibrated tubes are used as the basic material, said tubes having a relatively small wall thickness as compared to the tube diameter. However, such tubes with the required diameters and material quantities are not always available at advantageous prices. The use of the method of the prior art is further limited by the fact that one individual compression tool may be used for one rotor blank only, the diameter, eccentricity and axial pitch of which are precisely pre-determined; any deviation from one or several of the cited dimensions requires a separate compression tool or, at least a separate compression segment ring. In this manner, the manufacture of uncommon rotor sizes is so expensive that for such rotor size requirements the practice of using cutting tools is still adhered to, which, however, is not inexpensive because, depending on the rotor eccentricity, relatively large volumes have to be cut.

Another method is known, for instance from the German Pat. No. 1,091,072 and French Pat. No. 1,118,390, of manufacturing helical corrugated pipes by rotating a thin-walled smooth cylindrical tube around its axis and through a forming device which contains one or several forming rollers. The rollers are each rotatable around an axis which is adjusted at a slight angle to the longitudinal axis of the tube, corresponding to the axial pitch of the desired corrugated pipe. The rollers operate in the area of the front edge of a cylindrical arbor introduced into the smooth cylindrical inside of the tube and impress flutes into the wall of the tube, their axial pitch usually being only a small fraction of the outer diameter of the unshaped tube. The axial direction of the tube is not altered in this forming process. These devices of the prior art are useful only for the forming of thin-walled pipes and the cross-section of the rollers must be precisely adapted to the desired corrugated pipe profile. Using these devices, rotors or rotor blanks for helical gear motors or pumps whose axial pitch usually is a multiple of the original diameter of the shaft, cannot be manufactured even out of thin-walled tubes, much less can thick-walled pipes or rods with a solid cross-section be re-formed into rotor blanks.

SUMMARY OF THE INVENTION

The invention therefore is based on the task of providing a method of the type described at the outset, as well as of creating a device for the application of this method, by means of which rotor blanks for helical gear machines with different axial pitches and, preferably, also with diverse eccentricities and diverse rotor diameters can be manufactured without essential re-adjustments, and primarily, out of solid cylindrical shafts, but also out of thick-walled pipes. In this connection, the term rotor blanks is to be understood as referring to helical tubes with a circular cross section and a high axial pitch in relation thereto, in which the core diameter already corresponds to the diameter of the finished rotor or requires only minimal additional machining.

As far as it relates to a method, the task has been solved by the invention in that the shaft, during its motion along the shaft axis and during its simultaneous rotation about the shaft axis, is being bent into a direction which encloses a pre-set angle with the shaft axis.

By superimposing a bending operation to the axial motion and the rotation of the shaft, a helix is created, the axial pitch of which depends on the relation of the axial motion to the rotational motion and the eccentricity of which depends on the bending angle. Inasmuch as the cited influencing factors are easily technically variable in diverse manners, and inasmuch as an adaptation to different diameters of the circular cylindrical shafts used as basic material is easily possible, the method of the invention permits the manufacture of rotor blanks of great diversity. Substantial savings are made possible by the method of the invention, particularly in the manufacture of rotor blanks of great lengths and high axial pitches relative to the rotor diameter. If, in the foregoing, there was mention of helical gear machines, this term includes besides eccentric helical gear pumps, also helical gear motors, such as they are used, as an example, in drill holes as motors for rock drilling equipment driven by a flushing liquid. Especially these helical gear machines have particularly long stators and high axial pitches relative to the rotor diameter.

Preferably, the method of the invention is applied in such a manner that the shaft is longitudinally moved, rotated and bent in continuous motion. It is, however, possible to operate step by step, as long as the condition is adhered to that in each step the shaft is longitudinally advanced, rotated and bent, so that these processes practically are simultaneous.

For the application of the method of the invention, a device is provided, comprising, preferably, a clamping chuck which can be rotationally actuated and which is axially translatable along the shaft axis, and also comprising a forming tool, whereby said forming tool according to the invention has three bending rollers whose axes extend at least approximately at right angles to the shaft axis. While such forming devices are of record as rolling machines for the manufacture of rings out of rod-shaped material, they are unknown in a combination with a device for the rotation of the material about the shaft axis. If there is mention of three bending rollers, an arrangement of more than three bending rollers, as it is occasionally used in rolling machines, should not be excluded, even though the device with three bending rollers has proved to be the most effective.

As in the rolling machines of record, in the device of the invention, preferably at least one of the bending rollers is adjustable in relation to the other rollers. In this manner, the device can easily, and without exchanging the bending rollers, be adjusted for use with shafts of diverse diameters.

It is further preferable that, out of the given number of bending rollers, at least that roller which the shaft first reaches during its longitudinal forward motion, should have a ring groove to guide the shaft. In case the second bending roller has a ring groove, this groove is laterally displaced from the ring groove of the first bending roller. As an alternative, the ring groove of the second bending roller may be axially identical with the ring groove of the first bending roller, but it could be of correspondingly greater width. In case the third bending roller also has a ring groove, the same applies correspondingly. The measured degree of the lateral displacement of the ring groove depends, on the one hand, on the distance of the particular ring groove roller from the preceding bending roller, and on the other hand, on the bending angle of the shaft. This angle in turn depends on the desired eccentricity of the rotor.

The ring groove of the first bending roller preferably has a circular profile, tightly fitting the cross-section of the circular cylindrical shaft. The ring groove of the second, and if applicable, the third bending roller, however, has an elliptical profile, corresponding to a diagonal cut of the shaft at the very angle at which the shaft is being bent. Preferably, the first of the bending rollers can be rotationally actuated. The relation of the rotational speed of the first bending roller to the rotational speed of the clamping chuck is adjustable, preferably by means of an infinitely variable gear. Thus it is possible to determine experimentally the relation between the aforementioned rotational speeds required for the manufacture of rotors with precisely pre-determined axial pitch and to adapt it to the variable spring-back occurring at the rotor blank as it clears the bending rollers, and which varies with the different shaft materials and diameters used.

If one of the bending rollers is rotationally actuated, the clamping chuck may be pulled along by the shaft along the shaft axis. It is, however, preferable, again in view of the different spring-back properties of the shaft being processed, to use a device in which the clamping chuck cannot only be rotationally actuated but in which it also can independently be actuated for its motion along the shaft axis whereby, according to the invention, the relation between the longitudinal translation and the rotation of the clamping chuck is variable by means of an additional infinitely variable gear.

BRIEF DESCRIPTION OF THE DRAWINGS

Using the attached diagrammatic drawings, an embodiment of the invention is described as follows.

DESCRIPTION OF THE PREFERRED EMBODIMENTS

Figure 1:
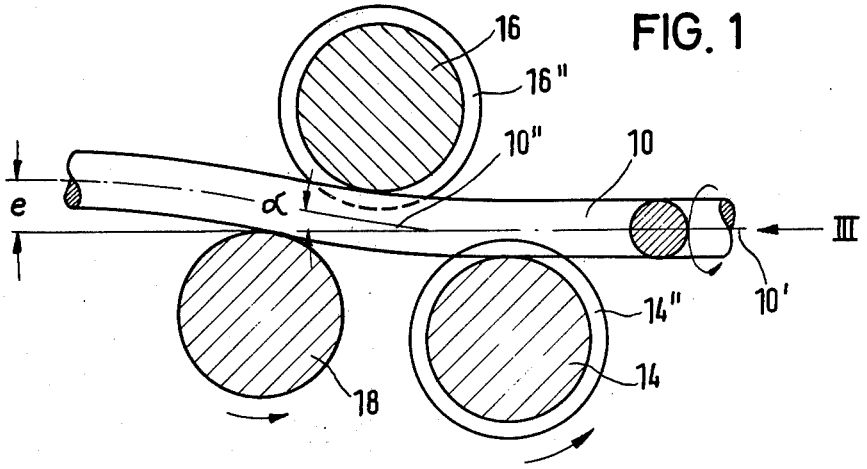
FIG. 1 shows the principle of the manufacture of helical rotor blanks as shown in the embodiment of a simplified device in a vertical longitudinal sectioned view.
Figure 2:
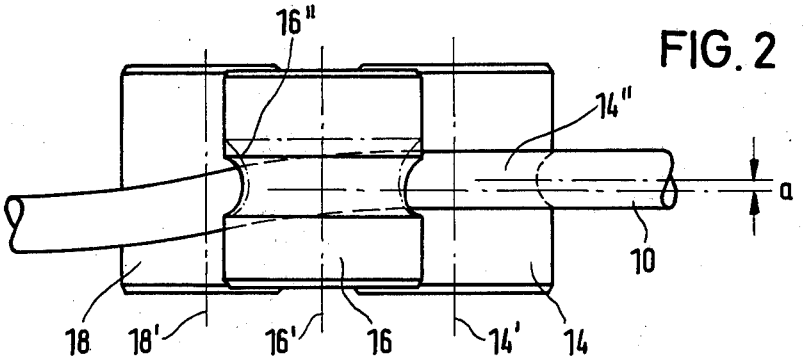
FIG. 2 shows the horizontal projection pertaining to FIG. 1.
Figure 3:
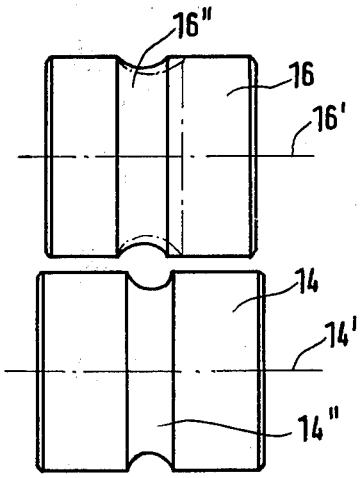
FIG. 3 shows the front view in the direction of arrow III of FIG. 1.

According to FIGS. 1 to 3, a steel shaft 10 having a circular cross-sectional area is guided through a forming device 12. In this process, the shaft 10 is advanced along its shaft axis 10' in the direction of the arrow III in FIG. 1, while simultaneously being rotated around said axis and being bent into a direction 10'', which direction subtends an angle $\alpha$ with the original direction of the shaft axis 10'.

Figure 6:
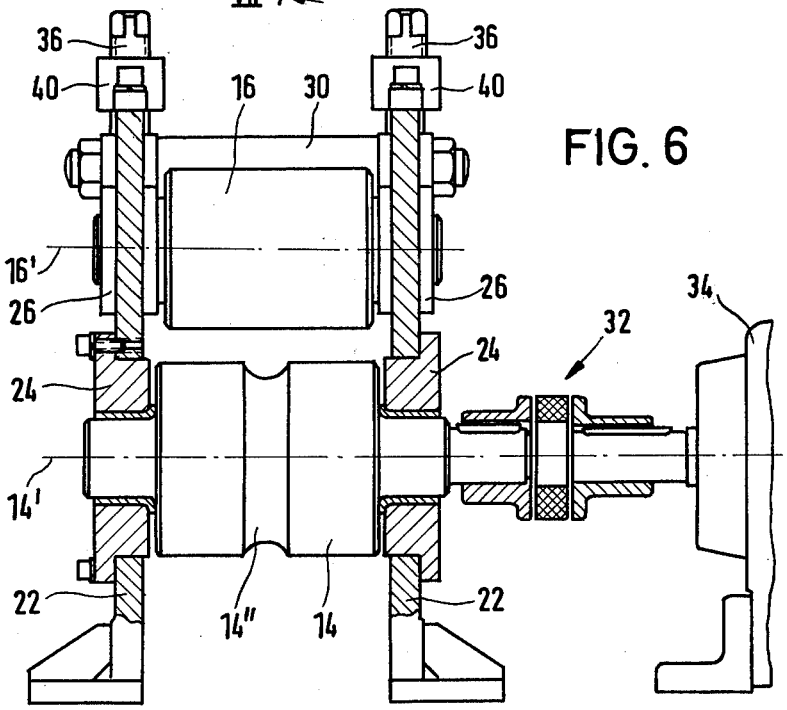
FIG. 6 shows the section along the lines VI—VI in FIG. 5.
Figure 9:
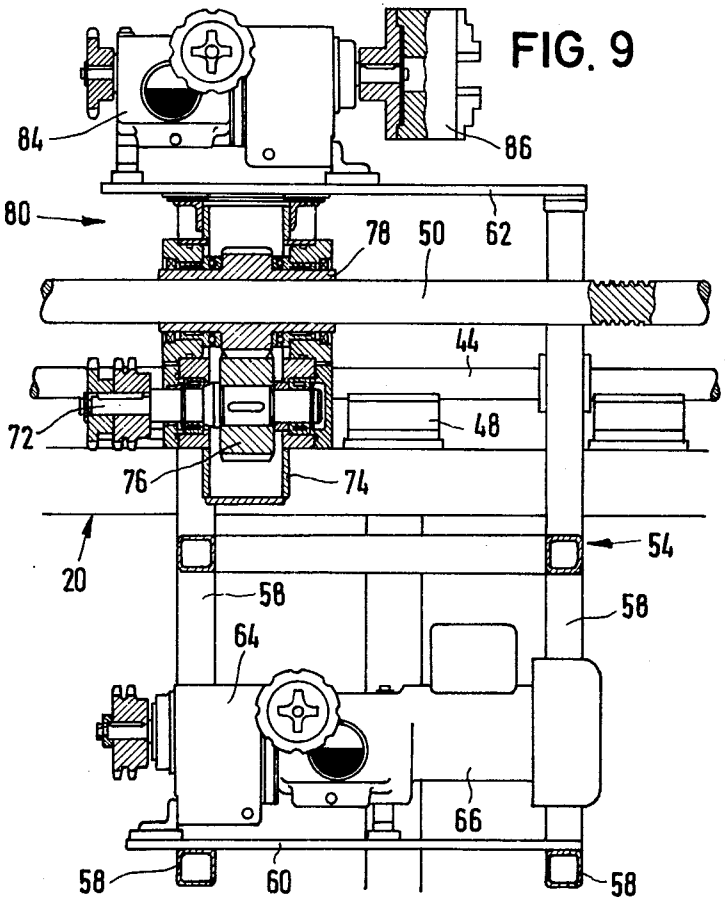
FIG. 9 shows the section along the lines IX—IX in FIG. 8.
Figure 8:
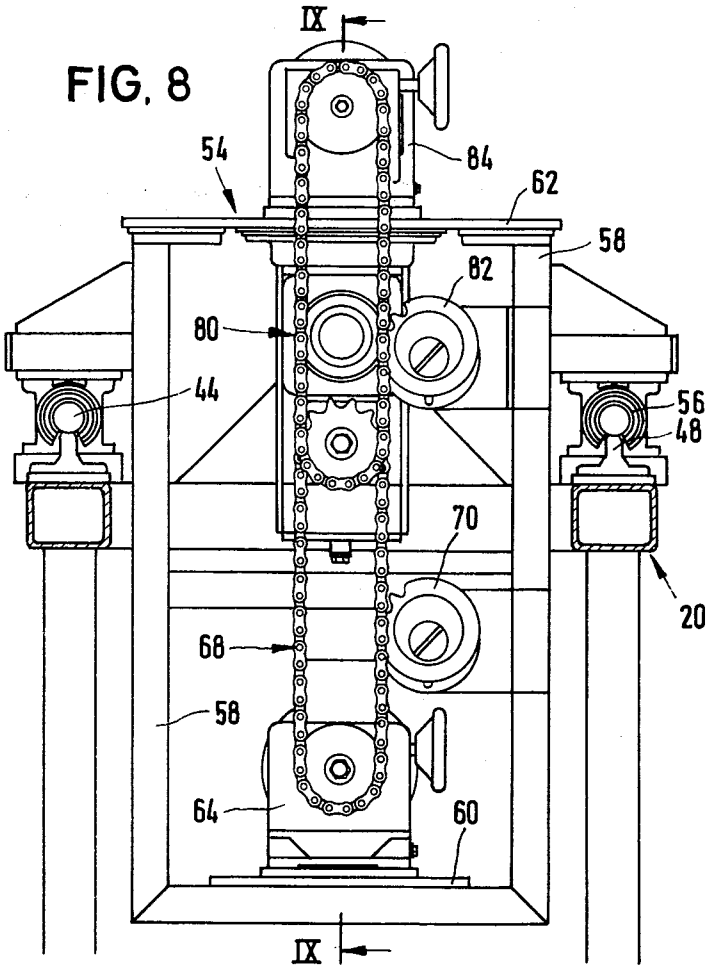
FIG. 8 shows an enlarged view of the device in the direction of the arrow III in FIG. 4.

The forming device 12 comprises three bending rollers 14, 16, 18 which are rotatably arranged on axes 14', 16' and 18' respectively, parallel to each other and at right angles to the shaft axis 10'. The bending roller 14 has a ring groove 14'' with a groove cross-section in the shape of a circular arc, fitting the shape of the cross-section of the shaft 10. According to FIGS. 1 to 3, the second bending roller 16 also has a ring groove 16'' but with a cross section in the shape of an elliptical arc, thus corresponding to a diagonal cut through the shaft 10. The ring groove 16'' is displaced by a distance a in relation to the ring groove 14'', or, alternatively, when not displaced, as indicated in dash-dotted lines in the drawings of FIGS. 2 and 3, it is about 2× a wider than ring groove 14''. The shaft 10 is guided within the ring grooves 14'' and 16'' in such a manner that it cannot shift along the axis 14'' and 16'', respectively, of the bending rollers 14 and 16. Under certain circumstances, the ring grooves 14'' and/or 16'' are not necessary, as for instance, in a situation where the shaft 10 is guided at a short distance from the bending roller 14, in a different manner, such as between two rollers whose rotational axes cross the axis 14''. In order to show that one or more ring grooves may be superfluous, the bending roller 16 in FIG. 6 is depicted without a ring groove. On the other hand, the bending roller 18 which is shown in FIGS. 1 and 2 without a ring groove, could be provided with a ring groove 16''.

The shaft emerging from the forming device 12 is of helical shape, the eccentricity e of which depends on the bending angle $\alpha$, and the axial pitch of which depends on the relation between the rotational speed of the shaft 10 about its axis 10' and the forward motion of the shaft along its axis.

The bending angle $\alpha$ necessary for a given eccentricity e in turn depends on the distance of the axis 16' of the bending roller 16 from the common plane of the axes 14' and 18' of the bending rollers 14 and 18.

Figure 4:
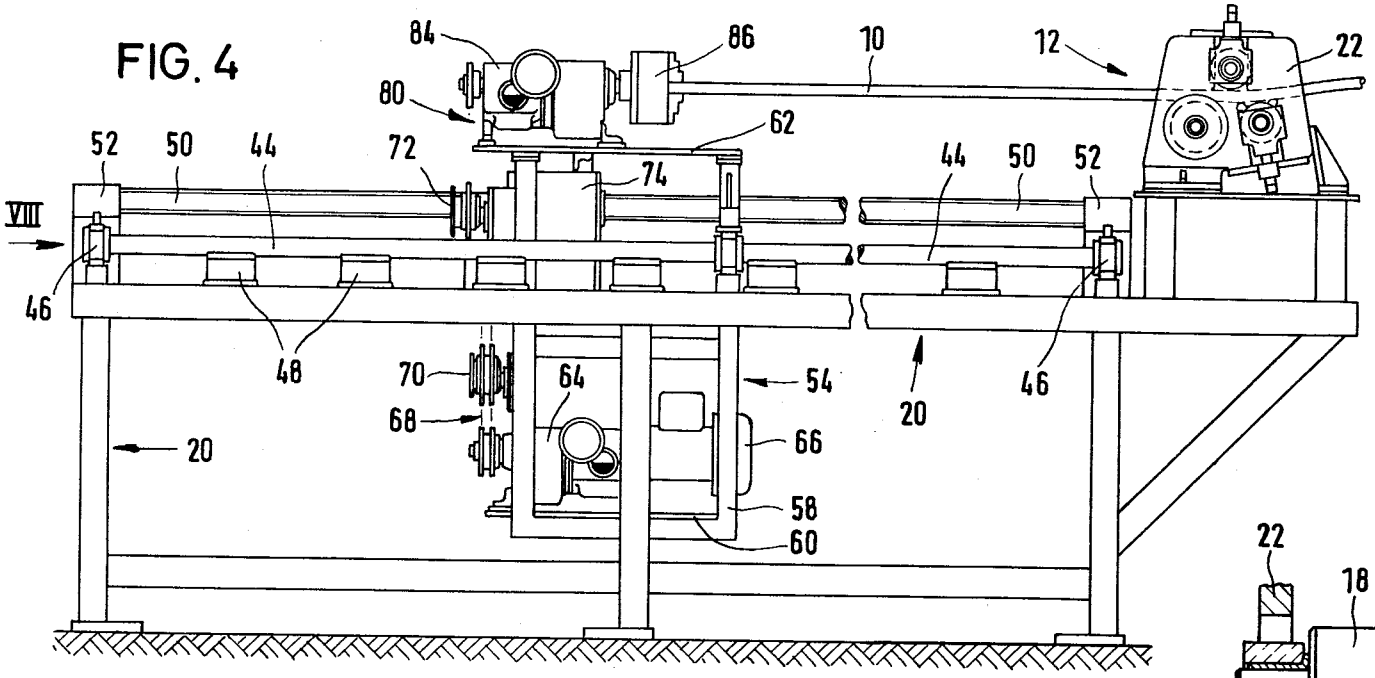
FIG. 4 shows a side view of a complete device for the manufacture of rotor blanks.
Figure 7:
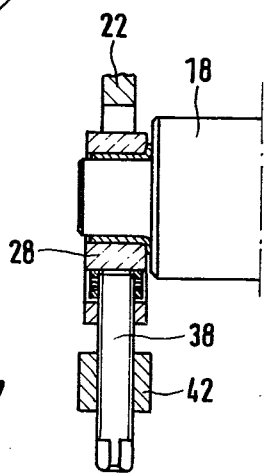
FIG. 7 shows the section along the lines VII—VII in FIG. 5.
Figure 5:
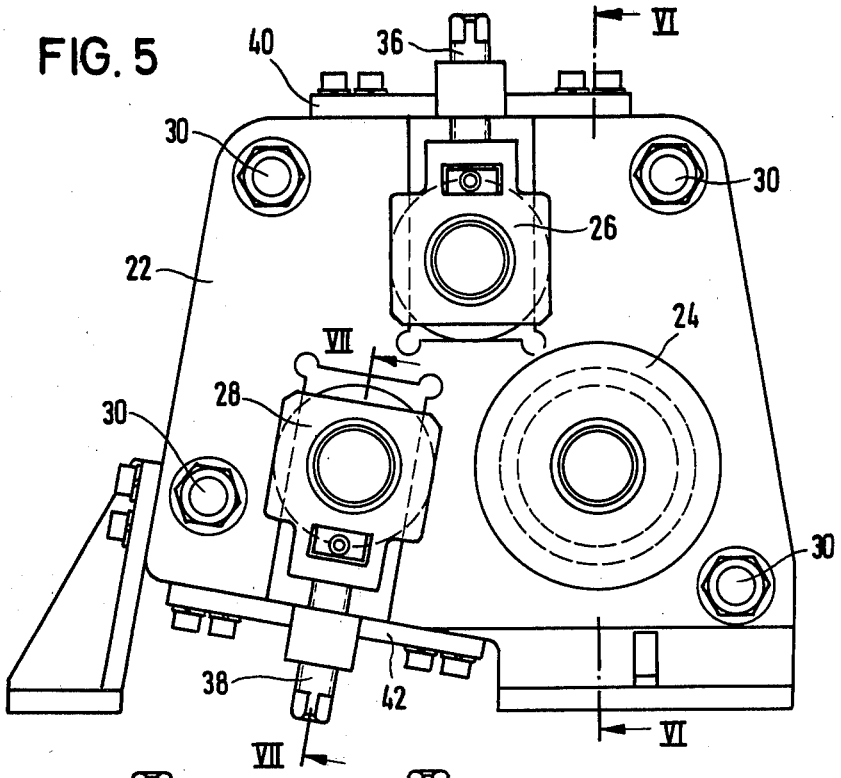
FIG. 5 shows an enlarged detail from the right side of FIG. 4.

An embodiment of the forming device 12 is shown in greater detail in FIGS. 4 to 7. The forming device 12 which, according to FIG. 4 is arranged at one end of an engine frame 20, has two vertical side plates 22, arranged in planes parallel to the shaft axis 10, in each of which side plates are held a bearing plate 24 for support of the bending roller 13, an upper bearing carriage 26 for the support of the bending roller 16, and a lower bearing carriage 28 for support of the bending roller 18. The side plates 22 are rigidly connected to each other with four stud bolts 30.

The bearing plates 24 are tightly screwed to the side plates 22 and the bending roller 14 held in said bearing plates 24 is connected to a motor 34 by means of a flexible coupling 32, the motor also being fastened to the engine frame 20.

The bearing carriages 26 are vertically translatably guided and the bearing carriages 28 are approximately vertically translatably guided within the side plates 22 and are each adjustable by means of an adjusting spindle 36 and 38, respectively, which are screwed into tie-bars 40 and 42, respectively.

On the engine frame 20, two horizontal guide rods 44 are arranged, parallel to the shaft axis 10', the ends of these rods 44 each being clamped into a stand 46 attached to the engine frame. In addition, each of the guide rods 44 is supported from below between the two stands 46 by means of stays 48, attached to the engine frame.

In the vertical center plane between the two guide rods 44 and parallel to them, a threaded spindle 50 is arranged, which at both of its ends is fastened to the engine frame by means of a stand 52.

On the two guide rods 44, a carriage 54 is movably held by means of slit guide bushings 56. The carriage 54 consists mainly of rectangular tubes 58 as well as a base plate 60 and a cover plate 62. An infinitely variable gear unit 64 is mounted on the base plate 60 and can be driven by a motor 66, flanged to the base plate. The output shaft of the gear unit 64 is connected to a countershaft 72 by means of an inverted link-belt chain drive 68 with a chain tension adjuster 70. The countershaft 72 is held parallel to the guide rods 44 and the threaded spindle 50 inside a housing 74 which is fastened to the bottom side of the cover plate 62.

Attached to the countershaft 72 is an intermediate pinion 76 meshing with a spindle nut 78 having external teeth. The spindle nut 78 is held axially immovable in the housing 74 and is screwed onto the threaded spindle 50.

The countershaft 72, by means of an additional link-belt chain drive 80, having its own chain tension adjuster 82, is connected to an additional infinitely variable gear unit 84, fastened to the cover plate 62. A clamping chuck 86 is fastened to the output shaft of the gear unit 84, wherein in the embodiment shown, chuck 86 is a four-jaw chuck of a design commonly used for lathes.

The device described by means of FIGS. 4 to 9 operates as follows:

The shaft 10, still straight, is placed with its front end, which in FIG. 4 is the right hand end, between the rollers 14, 16 and 18, and with its rear end clamped into the clamping chuck 86. The motor 34 is actuated so that it drives the bending rollers 14, 16, and 18, causing the rollers to move in the direction of the arrows shown in FIG. 1, thereby effecting a pulling of the shaft 10 into the direction of arrow III. As soon as the motor 66 also is actuated, the carriage 54 with the shaft 10 advances in the direction of the forming device 12 and simultaneously the clamping chuck 86 rotates the shaft 10. The relationship between the speed of the forward motion of the carriage 54 and the speed of the rotation of the bending rollers 14, 16 and 18 is infinitely variable at the gear unit 64. The relationship of the rotational speed of the clamping chuck 86 to the advancing motion of the carriage 54 is infinitely variable at the gear unit 84.

It will be obvious to those skilled in the art that various changes may be made without departing from the scope of the invention and the invention is not to be considered limited to what is shown in the drawings and described in the specification.

What is claimed is:

1. Apparatus for the manufacture of helical rotor blanks for helical gear machines from a straight cylindrical shaft by longitudinal movement of the shaft along the shaft axis and rotation of the shaft around the shaft axis while bending the shaft comprising a clamping chuck for holding an end of the shaft and having means to rotationally actuate and translate said chuck in the direction of the axis of the shaft connected thereto, a forming tool positioned to receive the shaft from the opposite end of the shaft, said forming tool including at least three bending rollers, the axes of which extend at least approximately at right angles to the shaft axis, a first bending roller of said at least three bending rollers, being the first reached by the shaft in its longitudinal movement, having a ring groove located for guiding the shaft, a second bending roller of said at least three bending rollers having a ring groove which is laterally displaced from said ring groove of said first bending roller.

2. Apparatus as claimed in claim 1, further characterized by at least one of said bending rollers being adjustable in relation to the others.

3. Apparatus as claimed in claim 1, further characterized by said ring groove of said first bending roller having a circular arc profile which is adapted to tightly fit the cross section of said cylindrical shaft, said ring groove of said second bending roller having an elliptical profile corresponding to a diagonal section of the shaft at an angle $\alpha$ at which the shaft is being bent.

4. Apparatus as claimed in claim 1, further characterized by one of said at least three bending rollers having means to rotatably actuate said roller, an infinitely variable gear means attached to vary the relationship of the rotational speed of said one bending roller to that of said clamping chuck.

5. Apparatus as claimed in claim 1, further characterized by said means to rotationally actuate and translate said chuck in the direction of the axis of the shaft including means to independently actuate said clamping chuck for its translational movement along the direction of the axis of the shaft, and an additional infinitely variable gear means to vary the relationship between the translational longitudinal movement and the rotation of said clamping chuck.

6. Apparatus for the manufacture of helical rotor blanks for helical gear machines from a straight cylindrical shaft by longitudinal movement of the shaft along the shaft axis and rotation of the shaft around the shaft axis while bending the shaft comprising a clamping chuck for holding an end of the shaft and having means to rotationally actuate and translate said chuck in the direction of the axis of the shaft connected thereto, a forming tool positioned to receive the shaft from the opposite end of the shaft, said forming tool including at least three bending rollers, the axes of which extend at least approximately at right angles to the shaft axis, a first bending roller of said at least three bending rollers, being the first reached by the shaft in its longitudinal movement, having a ring groove located for guiding the shaft, a second bending roller of said at least three bending rollers having a ring groove located axially identical to said ring groove of said first bending roller but being of greater width.

7. Apparatus as claimed in claim 6, further characterized by said ring groove of said first bending roller having a circular arc profile which is adapted to tightly fit the cross section of said cylindrical shaft, said ring groove of said second bending roller having an elliptical profile corresponding to a diagonal section of the shaft at an angle $\alpha$ at which the shaft is being bent.

8. Apparatus as claimed in claim 6, further characterized by at least one of said bending rollers being adjustable in relation to the others.

9. Apparatus as claimed in claim 6, further characterized by one of said at least three bending rollers having means to rotatably actuate said roller, an infinitely variable gear means attached to vary the relationship of the rotational speed of said one bending roller to that of said clamping chuck.

10. Apparatus as claimed in claim 6, further characterized by said means to rotationally actuate and translate said chuck in the direction of the axis of the shaft including means to independently actuate said clamping chuck for its translational movement along the direction of the axis of the shaft, and an additional infinitely variable gear means to vary the relationship between the translational longitudinal movement and the rotation of said clamping chuck.

* * * * *